US007748315B2

(12) United States Patent
Schlichter

(10) Patent No.: US 7,748,315 B2
(45) Date of Patent: Jul. 6, 2010

(54) SYSTEM AND METHOD FOR PACKAGING COTTON SLIVER

(75) Inventor: Stefan Schlichter, Viersen (DE)

(73) Assignee: Truetzschler GmbH & Co., KG, Moenchengladbach (DE)

( * ) Notice: Subject to any disclaimer, the term of this patent is extended or adjusted under 35 U.S.C. 154(b) by 296 days.

(21) Appl. No.: 11/514,149

(22) Filed: Sep. 1, 2006

(65) Prior Publication Data

US 2007/0074631 A1 Apr. 5, 2007

Related U.S. Application Data

(63) Continuation-in-part of application No. 11/247,276, filed on Oct. 12, 2005.

(30) Foreign Application Priority Data

Oct. 12, 2005 (IN) ..... 864/KOL/2005

(51) Int. Cl.
*B65B 13/20* (2006.01)
*B65B 27/12* (2006.01)
*B65H 54/00* (2006.01)

(52) U.S. Cl. ..... 100/3; 100/7; 242/361.4

(58) Field of Classification Search ..... 100/2, 100/3, 7, 8, 15, 18; 242/361.4, 361.5, 360, 242/363; 19/157, 159 A, 159 R, 160; 53/64, 53/67, 70, 71, 116, 117, 118, 235, 245, 249, 53/250, 251, 399, 429, 430, 473, 503, 589
See application file for complete search history.

(56) References Cited

U.S. PATENT DOCUMENTS

| | | | | |
|---|---|---|---|---|
| 928,563 | A | 7/1909 | Thoens | |
| 1,948,615 | A | 2/1934 | Clark | |
| 2,425,301 | A | 8/1947 | Browner | |
| 3,060,518 | A | 10/1962 | Hill | |
| 3,226,794 | A | 1/1966 | Erb | |
| 3,281,913 | A | 11/1966 | Morehead et al. | |
| 3,348,783 | A * | 10/1967 | Mackie | 242/472.2 |
| 3,482,795 | A | 12/1969 | Mackie | |
| 3,496,862 | A * | 2/1970 | Sowerby | 100/343 |

(Continued)

FOREIGN PATENT DOCUMENTS

| | | |
|---|---|---|
| CH | 1 28 869 | 11/1928 |

(Continued)

OTHER PUBLICATIONS

United Kingdom Search Report dated Mar. 13, 2006, issued in GB 0519748.8.

(Continued)

*Primary Examiner*—Jimmy T Nguyen
(74) *Attorney, Agent, or Firm*—Venable LLP; Robert Kinberg; Justine A. Gozzi

(57) ABSTRACT

A can-free system for handling fiber sliver includes a sliver delivery device which deposits fiber sliver in the form of a free-standing sliver pile in a depositing area. A sliver receiving device is disposed in the depositing area to receive and collect the free-standing fiber sliver pile delivered by the delivery device. A packaging apparatus compresses the collected free-standing fiber sliver pile applies one or more straps to the compressed free-standing sliver pile.

24 Claims, 12 Drawing Sheets

U.S. PATENT DOCUMENTS

| | | | | | |
|---|---|---|---|---|---|
| 3,509,687 | A | | 5/1970 | Fleissner | |
| 3,541,752 | A | | 11/1970 | Ness | |
| 3,808,641 | A | | 5/1974 | Schneider et al. | |
| 3,911,807 | A | * | 10/1975 | Birnbaum | 100/37 |
| 4,683,619 | A | | 8/1987 | Langen et al. | |
| 4,723,344 | A | | 2/1988 | Leifeld | |
| 4,891,918 | A | | 1/1990 | Wiley | |
| 4,956,969 | A | | 9/1990 | Raasch | |
| 5,081,744 | A | | 1/1992 | Siegenthaler et al. | |
| 5,085,377 | A | | 2/1992 | Rohrer et al. | |
| 5,125,210 | A | * | 6/1992 | Lang et al. | 53/399 |
| 5,200,269 | A | * | 4/1993 | Lukhard et al. | 428/362 |
| 5,257,897 | A | | 11/1993 | Yamamoto et al. | |
| 5,412,845 | A | | 5/1995 | Ueding et al. | |
| 5,446,946 | A | | 9/1995 | Leifeld | |
| 5,450,656 | A | | 9/1995 | Ueding et al. | |
| 5,491,877 | A | | 2/1996 | Leifeld | |
| 5,511,372 | A | | 4/1996 | Liedgens | |
| 5,528,797 | A | | 6/1996 | Otmar et al. | |
| 5,535,581 | A | | 7/1996 | Tahara et al. | |
| 5,560,179 | A | | 10/1996 | Leifeld | |
| 5,561,889 | A | | 10/1996 | Leifeld | |
| 5,575,040 | A | * | 11/1996 | Leifeld et al. | 19/159 A |
| 5,581,849 | A | | 12/1996 | Kriegler et al. | |
| 5,595,049 | A | | 1/1997 | Leifeld | |
| 5,787,553 | A | | 8/1998 | Liedgens | |
| 5,826,812 | A | | 10/1998 | Hand | |
| 5,829,100 | A | | 11/1998 | Stentenbach | |
| 5,881,861 | A | | 3/1999 | Langen | |
| 6,182,425 | B1 | | 2/2001 | Ficker et al. | |
| 6,279,306 | B1 | | 8/2001 | Langen | |
| 6,334,237 | B1 | | 1/2002 | Tsuzuki | |
| 6,345,417 | B2 | | 2/2002 | Leder et al. | |
| 6,425,163 | B1 | | 7/2002 | Von Gehlen | |
| 7,410,051 | B2 | | 8/2008 | Warlick | |
| 2003/0146331 | A1 | | 8/2003 | Schlichter | |
| 2006/0027695 | A1 | | 2/2006 | Schlichter | |
| 2006/0065554 | A1 | | 3/2006 | Warlick | |
| 2007/0063088 | A1 | | 3/2007 | Schlichter | |
| 2007/0063089 | A1 | | 3/2007 | Schlichter | |
| 2007/0068397 | A1 | | 3/2007 | Schlichter | |
| 2007/0069058 | A1 | | 3/2007 | Schlichter | |
| 2007/0069059 | A1 | | 3/2007 | Schlichter | |
| 2008/0029637 | A1 | | 2/2008 | Schlichter | |
| 2008/0244871 | A1 | | 10/2008 | Vollrath | |

FOREIGN PATENT DOCUMENTS

| | | | |
|---|---|---|---|
| CH | 436 199 | | 5/1967 |
| CH | 418 908 | | 8/1986 |
| DE | 575 175 | A | 4/1933 |
| DE | 1081823 | B | 8/1962 |
| DE | 1 145 062 | | 3/1963 |
| DE | 1 875 947 | U | 7/1963 |
| DE | 3422 140 | A1 | 12/1985 |
| DE | 38 19 854 | A1 | 1/1989 |
| DE | 37 34 425 | C2 | 3/1989 |
| DE | 40 18 088 | | 1/1991 |
| DE | 42 17 981 | C2 | 12/1993 |
| DE | 43 04 988 | C1 | 4/1994 |
| DE | 44 07849 | | 11/1994 |
| DE | 4432634 | | 3/1996 |
| DE | 1 9611500 | | 1/1997 |
| DE | 195 42 599 | A1 | 5/1997 |
| DE | 37 38 190 | C2 | 10/1997 |
| DE | 19850092 | | 5/2000 |
| DE | 102 05 061 | A1 | 2/2002 |
| DE | 10252174 | | 5/2004 |
| EP | 0311394 | | 4/1989 |
| EP | 0320467 | A1 | 6/1989 |
| EP | 0 457 099 | | 4/1994 |
| FR | 650.306 | B | 1/1929 |
| FR | 1.226.668 | | 7/1960 |
| FR | 1.395.509 | | 3/1965 |
| FR | 2021647 | | 7/1970 |
| FR | 2540476 | A1 | 10/1984 |
| GB | 298 442 | | 10/1928 |
| GB | 314 190 | | 6/1929 |
| GB | 317 029 | | 8/1929 |
| GB | 412 893 | | 7/1934 |
| GB | 966 294 | | 8/1964 |
| GB | 1166650 | A | 10/1969 |
| GB | 1397812 | | 6/1975 |
| GB | 1555650 | | 11/1979 |
| GB | 2205544 | | 12/1988 |
| GB | 2277936 | | 11/1994 |
| GB | 2287964 | | 10/1995 |
| GB | 2292392 | | 2/1996 |
| GB | 2385064 | | 8/2003 |
| GB | 242 0107 | | 5/2006 |
| JP | 6 104 7835 | | 3/1986 |
| JP | 61-45868 | | 3/1986 |
| WO | WO 03/078253 | A1 | 9/2003 |

OTHER PUBLICATIONS

German Search Report Dated Nov. 17, 2006, Issued DE 10 2005 045472.0.

Turkish Search Report dated Jul. 30, 2008, issued in Turkish Application No. 2006/04816.

British Search Report dated Jun. 30, 2008, issued in British Application No. GB0805586.5.

British Search Report dated Feb. 12, 2007 issued in British Application No. GB0620168.5.

British Search Report dated Feb. 20, 2007 issued in British Application No. GB0620181.8.

British Search Report dated Feb. 21, 2007 issued in British Application No. GB0620179.2.

German Search Report dated Sep. 1, 2006 issued in German Application No. 102006012 581.9.

German Search Report dated Sep. 1, 2006 issued in German Application No. 10 2006 012 483.9.

German Search Report dated Dec. 18, 2007 issued in German Application No. 10 2007 016 340.3 and translation.

German Search Report dated Sep. 5, 2006, issued in German Application No. 10 2006 012 579.7, and translation.

British Search Report dated Feb. 12, 2007 issued in British Application No. GB 0620182.6.

British Search Report dated Feb. 12, 2007 issued in British Application No. GB 0620172.7.

German Search Report dated Sep. 25, 2006, issued in German Application No. 10 2006 012 565.7, and translation.

German Search Report dated Sep. 1, 2006 issued in German Application No. 10 2006 012 484.7, and translation.

British Search Report dated Feb. 12, 2007 based on British Application No. GB 0620170.1.

Search Report from German Application No. 10 2006 012 580.0 dated Sep. 7, 2006.

MI Ravskiy "Apparatus for loosening up cotton packs", 1969.

* cited by examiner

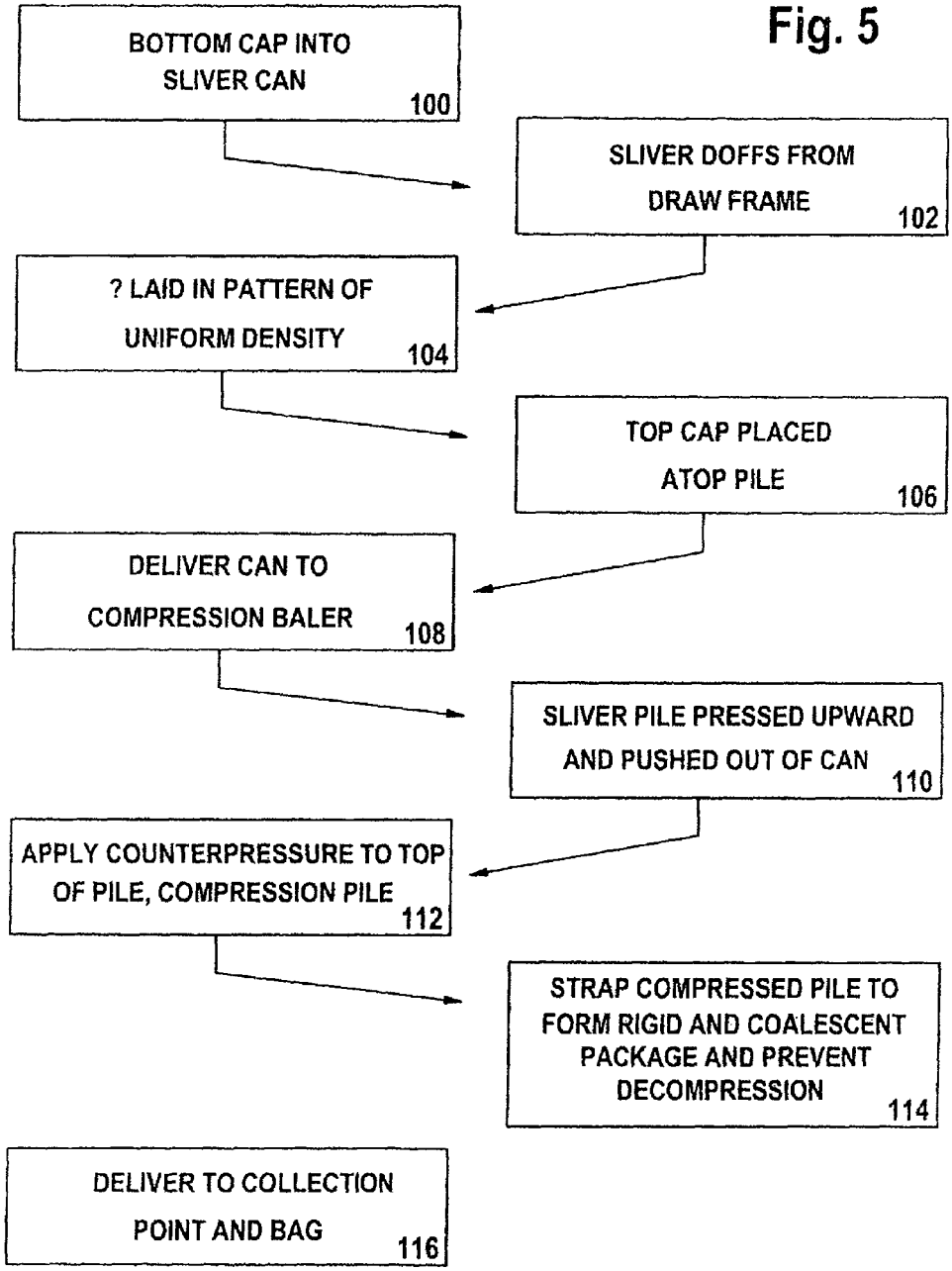
Fig. 5
BOTTOM CAP INTO SLIVER CAN 100
SLIVER DOFFS FROM DRAW FRAME 102
? LAID IN PATTERN OF UNIFORM DENSITY 104
TOP CAP PLACED ATOP PILE 106
DELIVER CAN TO COMPRESSION BALER 108
SLIVER PILE PRESSED UPWARD AND PUSHED OUT OF CAN 110
APPLY COUNTERPRESSURE TO TOP OF PILE, COMPRESSION PILE 112
STRAP COMPRESSED PILE TO FORM RIGID AND COALESCENT PACKAGE AND PREVENT DECOMPRESSION 114
DELIVER TO COLLECTION POINT AND BAG 116

SYSTEM AND METHOD FOR PACKAGING COTTON SLIVER

CROSS-REFERENCE TO RELATED APPLICATIONS

This application is a continuation-in-part of U.S. application Ser. No. 11/247,276, filed Oct. 12, 2005, the disclosure of which is incorporated herein by reference. The present application additionally claims priority from Indian Application No. IN 864 filed in India on Sep. 19, 2005, the disclosure of which is also incorporated herein by reference.

BACKGROUND OF THE INVENTION

The present invention relates to a system and method for efficiently packaging cotton sliver for handling and transport.

The process of producing yarns from staple fibers, such as cotton, traditionally includes, between the step of opening and cleaning of the staple fiber and the step of spinning and winding of the yarn, an intermediate step comprising the formation of a loosely coalescent, bulky strand of fibers known as sliver. The cotton fibers in sliver are generally aligned in lengthwise relation, but the sliver does not possess any twist or strength against separation of the fibers, even against its own weight.

As those skilled in the art of yarn making will recognize, the quality of the yarn relates directly to the quality of the sliver. For instance, sliver of a uniform thickness and density forms a uniform, consistently strong yarn, while a sliver that has bumps (extra thick regions) or voids (thinner regions) will form a yarn of inconsistent quality. While processes have been developed that enable such imperfections to be cut from a yarn during processing, this is an inefficient process, and it is therefore desirable to minimize imperfections in the sliver. During handling, sliver is particularly susceptible to the introduction of bumps and voids because of its lack of strength and resiliency.

For those reasons, the prevailing conventional view has been that the packaging of sliver is difficult and undesirable, both because of the additional handling and movement of the sliver that would be required, and because the traditional methods of handling sliver did not lend themselves to a packaging solution. However, this convention stands at odds with modern distributed manufacturing processes. In many cases, it is considered to be more efficient to specialize the functions of a processing plant, such that a portion of the yarn making process occurs in one plant, a second portion in another, and a third portion in yet another. However, if a particular function, such as the forming of sliver, is to be specialized into a plant, it is necessary for the sliver to be transported.

Traditionally, sliver is drawn from processed bulk cotton using a draw frame, a card, or a comb, and deposited in circular rows into a cylindrical sliver can made of plastic or another durable material. These sliver cans allow large volumes of sliver to be moved without excessively handling the sliver, but they are expensive and heavy. If the distance to be traversed is small, such as different buildings in a plant complex, then the sliver could be transported in sliver cans without great difficulty. However, if the distance to be traversed is large, such as would make use of over-the-road or overseas transport, then the weight and expense of the cans, the necessity of transporting empty cans, and the minimal density of uncompressed sliver make such transport imprudent and inefficient. Generally, the determinative factor concerning the expense of transporting cotton is not the weight of the material, but the bulk.

Conventional methods of compressing cotton fiber, such as baling, have proven impractical for sliver deposited in conventional cylindrical cans. The reason for this is that the conventional pattern of deposition of sliver into a cylindrical can in essentially concentric circular rows of sliver, does not result in a substantially uniform density of sliver. Specifically, the density of sliver in the center of the can is higher than the density of sliver near the edge. If sliver in a cylindrical can is compressed to its maximum practical density at the center of the can, then the sliver at the edge is insufficiently compressed to allow the resulting compressed package to be handled. Such compression does not result in a stable package. Compression of the sliver has heretofore been thought to be impractical.

Consequently, the usual practice is to conduct substantially all of the steps by which staple fiber is processed into yarn in the same location. This is, however, an inflexible, capital-intensive, and inefficient arrangement in many cases, because of a desire on the part of yarn makers to conduct some operations, such as cleaning and carding, near the cotton gin, and therefore near the cotton fields. Other operations, such as spinning, may be conducted in an area where labor or equipment costs might be lower.

What is needed is a system for and a method of packaging sliver in a manner that preserves the physical integrity of the sliver, while permitting efficient transport in a compressed state, without requiring transport to be made in a sliver can.

SUMMARY OF THE INVENTION

In an exemplary embodiment of the invention there is provided a can-free system for handling fiber sliver, comprising: a sliver delivery device which deposits fiber sliver in the form of a free-standing sliver pile in a depositing area; a sliver receiving device disposed in the depositing area to receive and collect the free-standing fiber sliver pile delivered by the delivery device; and a packaging apparatus comprising a device to compress the collected free-standing fiber sliver pile and a device to apply one or more straps to the compressed free-standing sliver pile.

According to another exemplary embodiment of the invention, the sliver pile may be placed on a bottom cap, and the system further includes a mechanism to place a top cap onto the free-standing sliver pile, whereby the sliver pile is compressed between the top cap and the bottom cap.

According to a further exemplary embodiment of the invention, at least one of the caps may be formed of fiberboard, corrugated cardboard, or plastic. The strapped pile is preferably sufficiently rigid to form a coalescent unit.

In a further exemplary embodiment, the sliver receiving device may include a receiving surface that serves both as a receiving surface and a bottom cap.

In anther exemplary embodiment, the receiving surface may comprise a first planar surface that first receives the fiber sliver, and there is additionally provided a mechanism to thereafter transfer the free-standing sliver pile from the first planar surface onto a bottom cap.

BRIEF DESCRIPTION OF THE DRAWINGS

Further features, embodiments, and advantages of the present invention will become apparent from the following detailed description, with reference to the drawings, wherein:

FIG. 5 is a schematic flow chart showing a compression method according to the present invention.

DETAILED DESCRIPTION OF THE INVENTION

Figure 1:
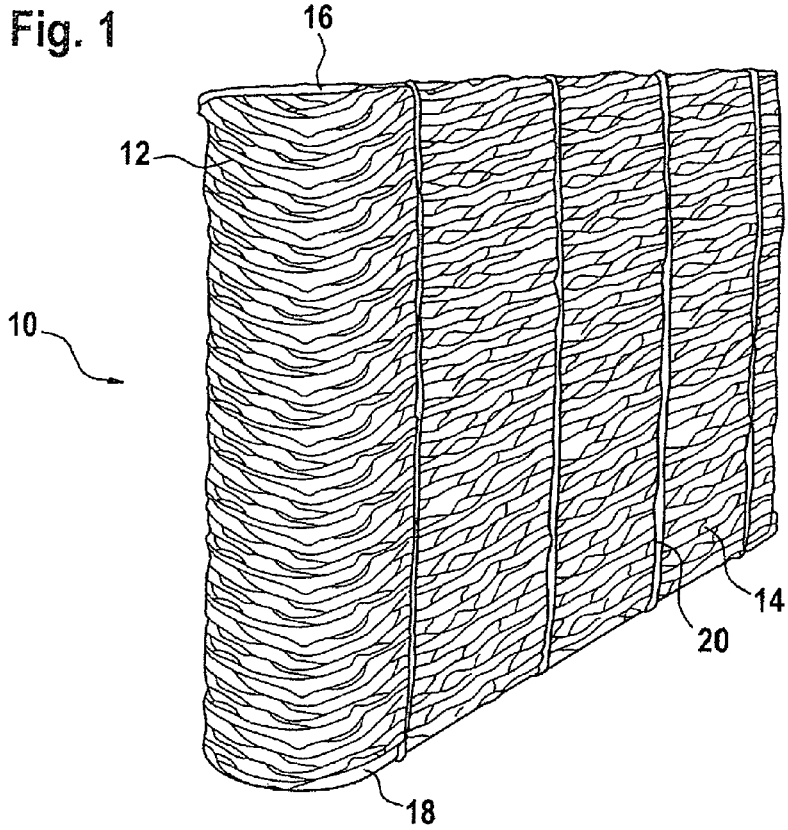
FIG. 1 is a general perspective view of a sliver package that result from the present invention.
Figure 1A:
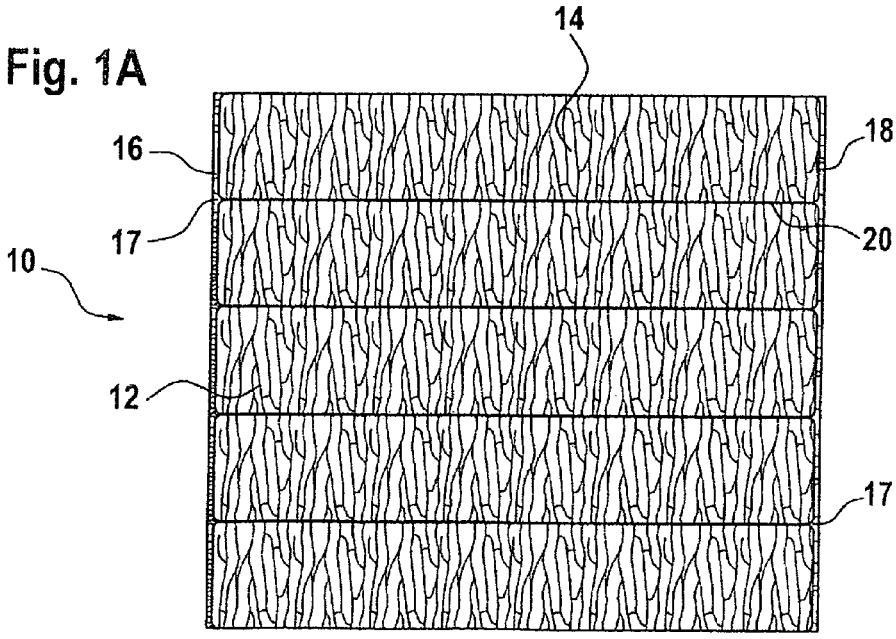
FIG. 1A is a lateral view of the sliver package as shown in FIG. 1.

Referring now to the drawings, FIGS. 1 and 1A illustrate, respectively in perspective and side views, a sliver package 10 according to the present invention which has been compressed and banded for efficient transport. Sliver package 10 includes a substantially continuous length of cotton sliver 12 accumulated into a pile that has an oblong footprint. The density of the pile of cotton sliver is substantially uniform throughout because the sliver draft 12 has been laid in a pattern of offset loops designed to produce a uniform density as compared to the density produced when sliver is laid with a circular footprint in conventional systems.

In FIGS. 1 and 1A, the pile has been compressed to a substantially higher, substantially uniform compressed density such that the sides 14 of the sliver package 10 are sufficiently rigid and coherent as to allow the package to be handled without damaging or disturbing the sliver draft 12 at the sides 14 of the sliver package 10. Because of the uniform density of the sliver pile as it is initially laid (in a process to be described in greater detail below), the pile may be compressed by the introduction from the top and the bottom of a compressive force, which maintains the uniformity of density of the sliver pile throughout the compression process.

The compressive force is applied, more specifically, to a top cap 16 and a bottom cap 18, which provide rigid surfaces against which the compressive force may be applied. The top and bottom caps 16,18 are substantially similar and are preferably formed of a material such as fiberboard, corrugated cardboard, plastic, or any other suitable material of sufficient rigidity and durability to survive the compression process and to maintain the sliver package 10 in a compressed state. The top and bottom caps 16,18 are maintained in their compressed locations by a number of straps or bands 20, formed of fiber-reinforced plastic or another suitable material, which encircle the sliver package 10 (including the caps 16,18) and maintain the compressive force upon the caps 16,18 and, by extension, the sliver pile 12.

The strapped sliver package 10 may be provided with a cover of polyethylene or another suitable material in order to protect the sliver from being soiled or damaged in transport. The strapped pile is sufficiently rigid, because of the uniformity of sliver density and the structural reinforcement presented by the caps 16,18 and straps, to be a coalescent unit capable of being handled substantially without damage to the sliver. Once the sliver package 10 has been transported to the desired location, the straps may be removed from the sliver package 10 which may be allowed to relax, and the sliver draft 12 may be used as normal in further yarn making operations.

Figure 2:
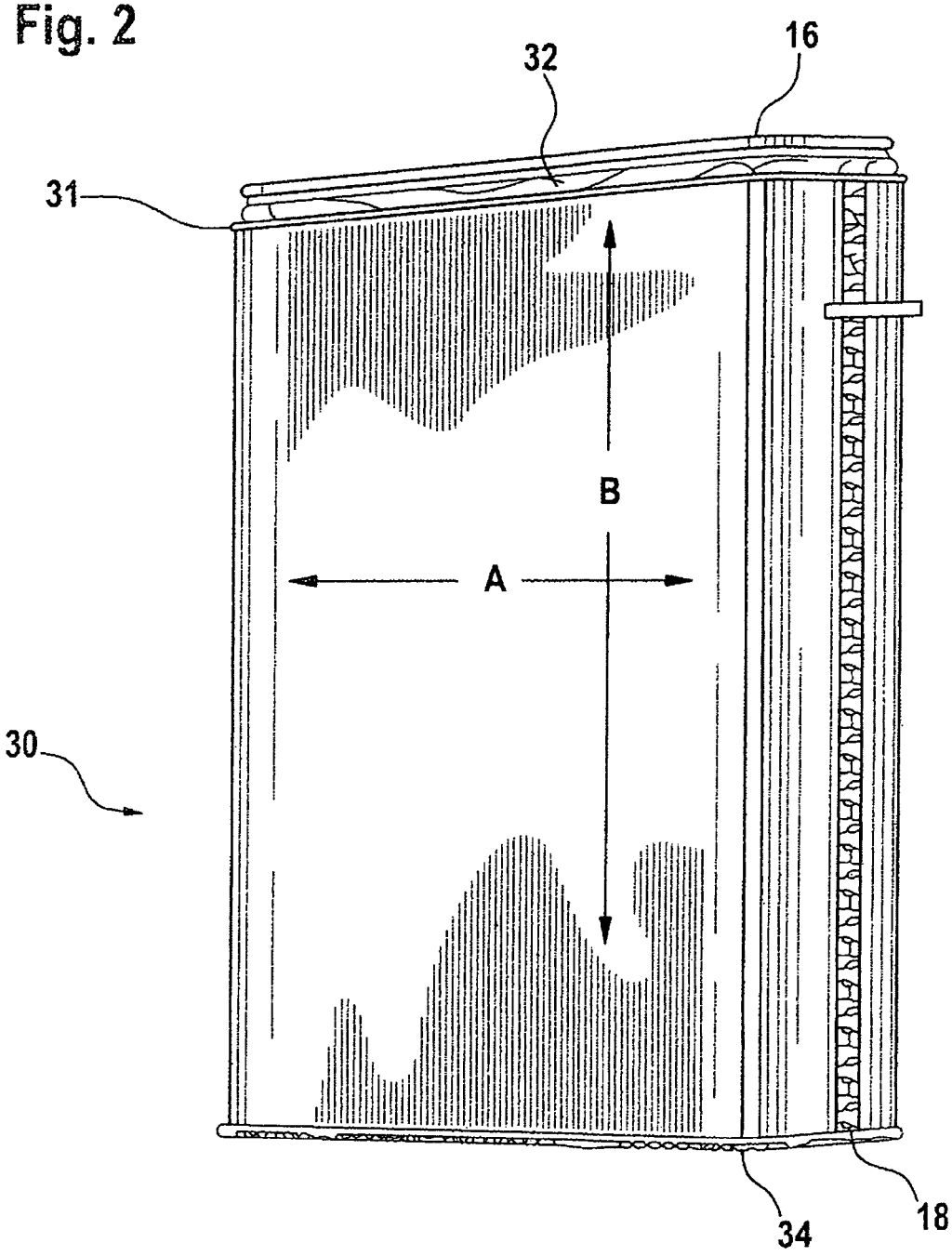
FIG. 2 is a perspective view of a loaded sliver can.

Referring now to FIG. 2, there is shown a known system and method for packaging sliver that is first deposited in a can. See for example U.S. Patent Application Publication No. 2006/0065554, filed Sep. 28, 2004, the disclosure of which is incorporated herein by reference. FIG. 2 shows a sliver can 30 in a perspective view. The sliver can has an open top 31 and has been loaded with sliver 32 drawn from a draw frame (not shown) and laid in a pattern of substantially uniform density to form a pile 12. The sliver can 30, in comparison with conventional cylindrical sliver cans, is oblong, and this oblong shape allows the sliver 32 to be laid in a pattern of offset circles that permits a substantially uniform density throughout the pile 12. The sliver can 30 is provided with an apertured base 34 that will permit the sliver pile 12 to be pushed upward and out of the can 30, while still providing sufficient support to retain the sliver pile 12 in the can for short-range transport. As can be seen in FIG. 2, the sliver can has a widthwise dimension A and a lengthwise dimension B that is substantially longer than the widthwise dimension A.

A bottom cap 18 having an oblong footprint is placed at the bottom of the sliver can prior to filling, and this bottom cap 18 will form the base of the sliver package. The sliver 32 is then laid in the can 30 on top of the bottom cap 18. The basic elements of the package are completed by the placement of a top cap 16, having the same profile as the bottom cap 18, on top of the full sliver can 30 and the sliver 32 accumulated into the pile 12.

Figure 3:
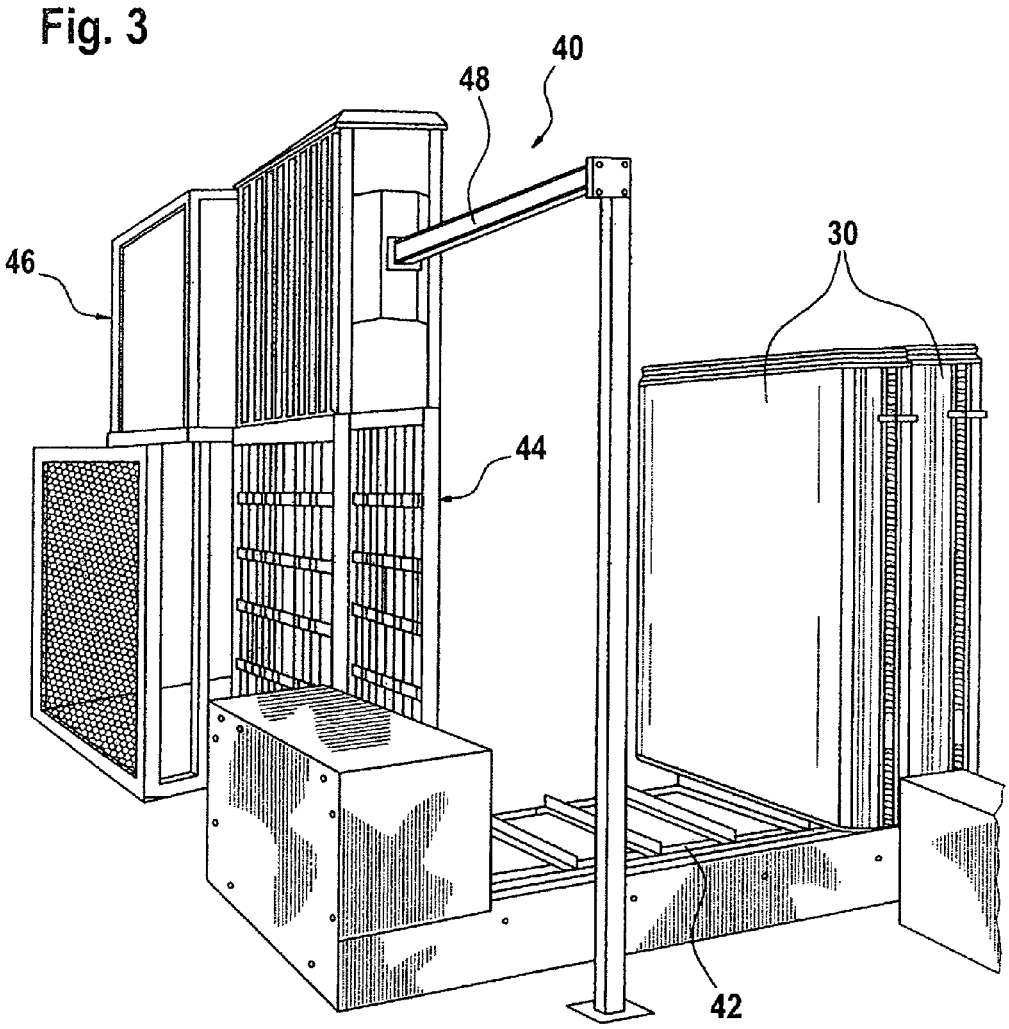
FIG. 3 is a perspective view of a packaging system according to the present invention.

The filled sliver can 30 shown in FIG. 2 is then transported to baler apparatus 40, which is shown in a perspective view in FIG. 3. The sliver can 30 is doffed from the draw frame (not shown) onto a conveyor 42, which is capable of accommodating a number of sliver cans 30 in a queue for processing. Conveyor 42 is directed at the baler apparatus 40, which includes a compression section 44, an elevator section 46, means for pushing the sliver package 10 (such as piston 48), and a second conveyor 50 (FIGS. 4A-4E) for delivering the sliver package 10 and the now-empty sliver can 30 to a collection location.

Figure 4A:
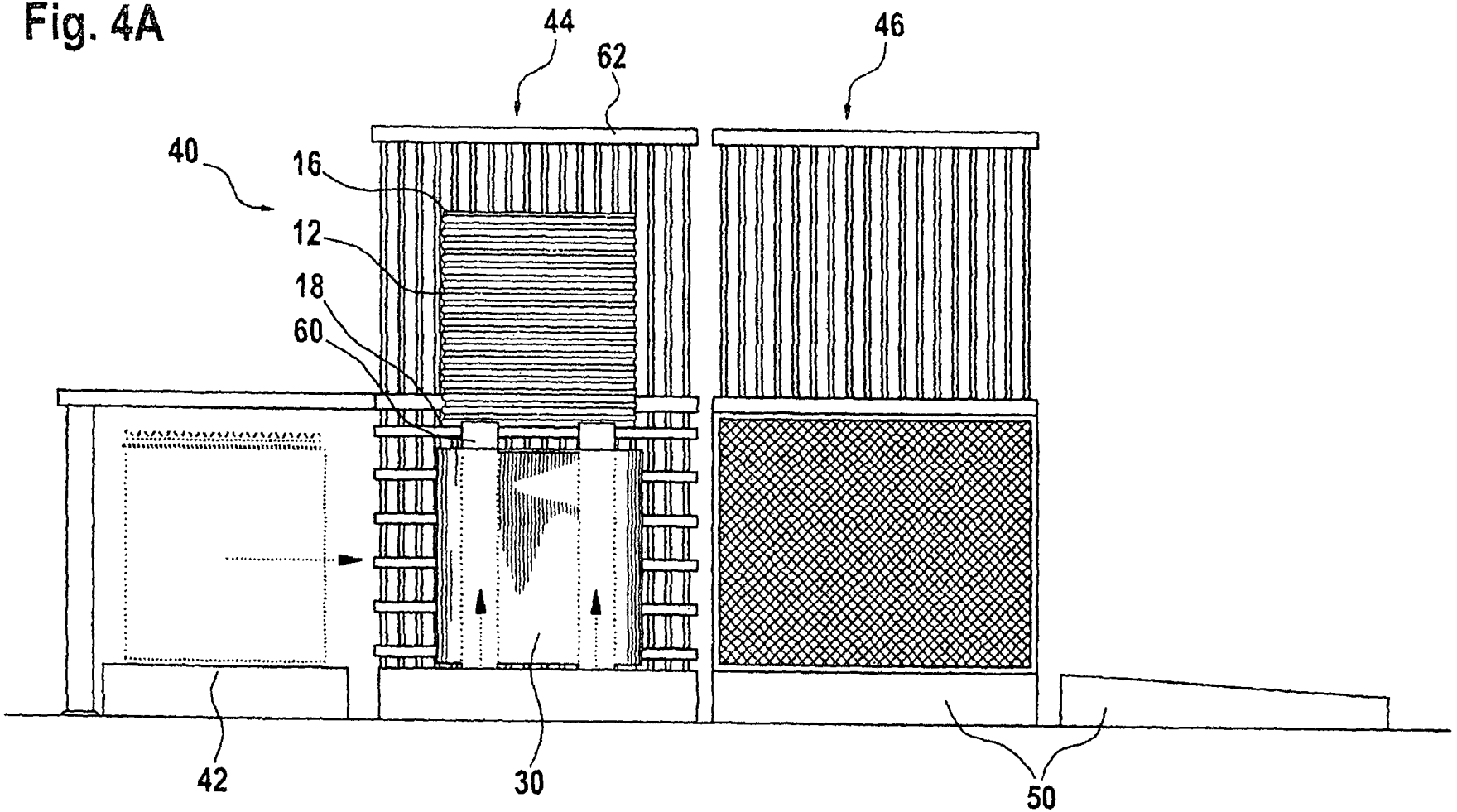
FIGS. 4A-4E show a sequence of views of a compression method according to the present invention.
Figure 4B:
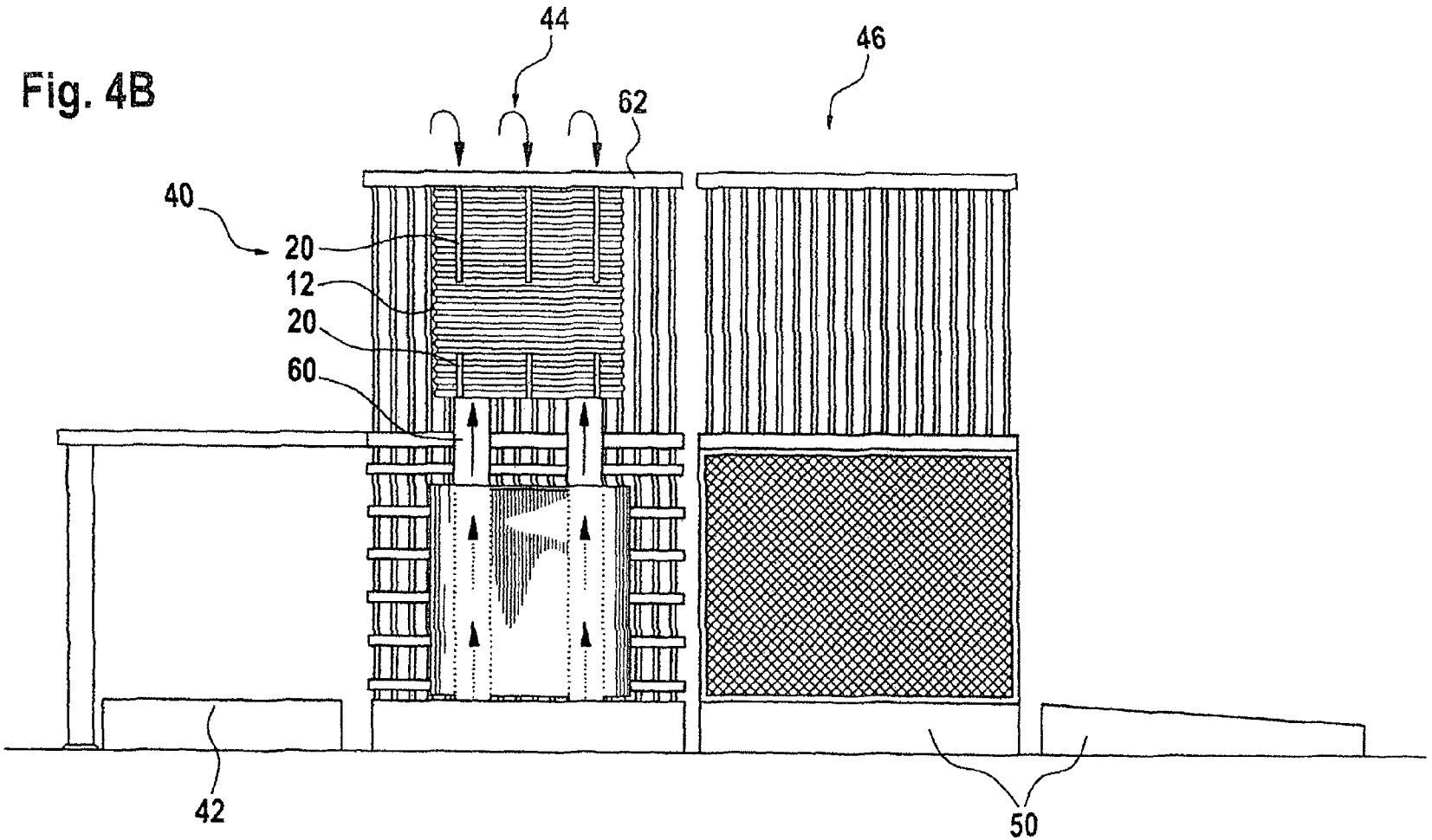

An exemplary embodiment of the sections of the baler apparatus 40 is shown in greater detail in connection with FIGS. 4A-4E. FIG. 4A shows a filled sliver can 30 being deposited into the compression area 44. A ram 60 is extended through the apertures in the base 34 of the sliver can 30 and exerts an upward force upon the bottom cap 18 and thus the sliver pile 12, driving the sliver pile 12 upward against a means, such as a rigid plate 62, for applying counter-pressure to the top cap 16 and the sliver pile 12 as shown in FIG. 4B.

Figure 4C:
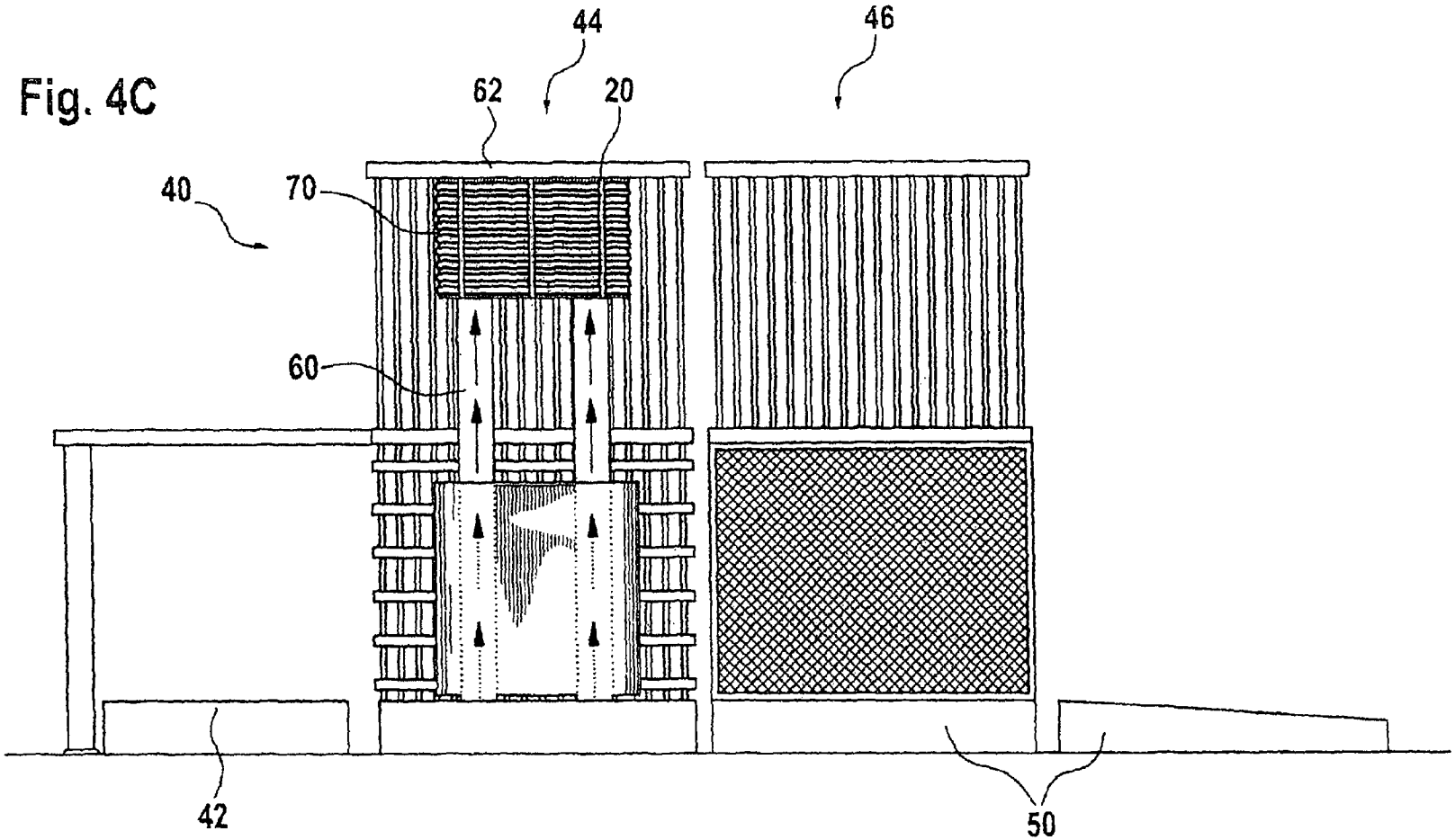

The compression area 44 is sized to prevent the widthwise expansion or disintegration of the sliver pile 12 as it is removed from the sliver can 30. Consequently, an even pressure, preferred to be about 3600 psi or any other suitable pressure, is applied to compress the sliver pile 12 into a smaller, denser but still uniformly dense, coalescent unit 70 as shown in FIG. 4C.

As part of the compression process, a set of straps 20 are placed about the sliver pile 12 in order to retain the coalescent unit 70 in its compressed state following compression. In FIG. 4B, these straps 20 are shown extending not quite fully around the sliver pile 12, but as the pile 12 is compressed as shown in FIG. 4C, the straps 20 may then reach completely around the sliver pile 12 and may be fastened upon each other in the conventional manner. Because the straps 20 encircle the caps 16,18 as well, the caps 16,18 are preferably provided with a corresponding set of recesses 17 (FIG. 1A) that locate the straps 20 in the proper place and ensure that sufficient strapping is in place to prevent the unwanted decompression of the package 70.

Figure 4D:
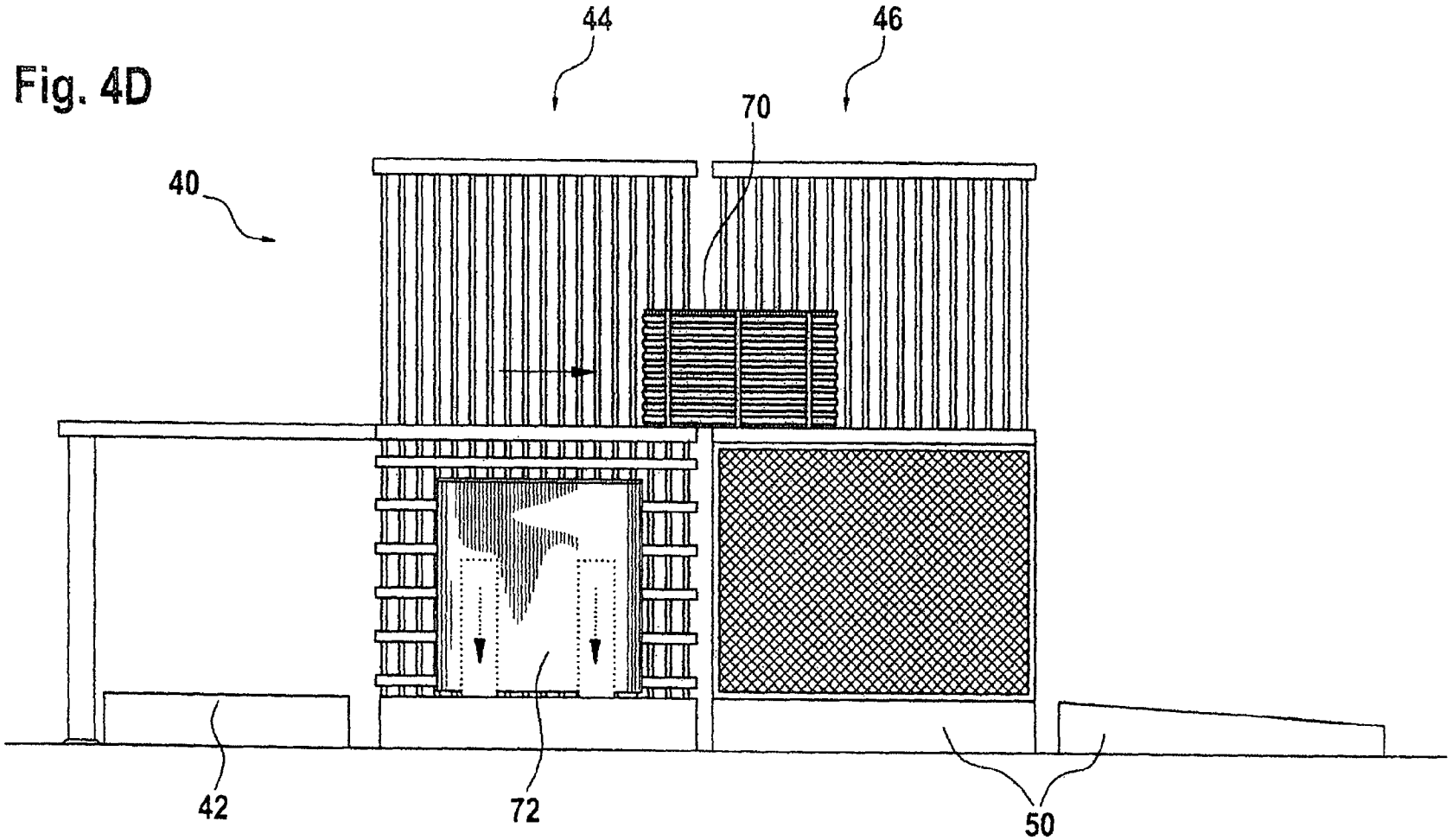
Figure 4E:
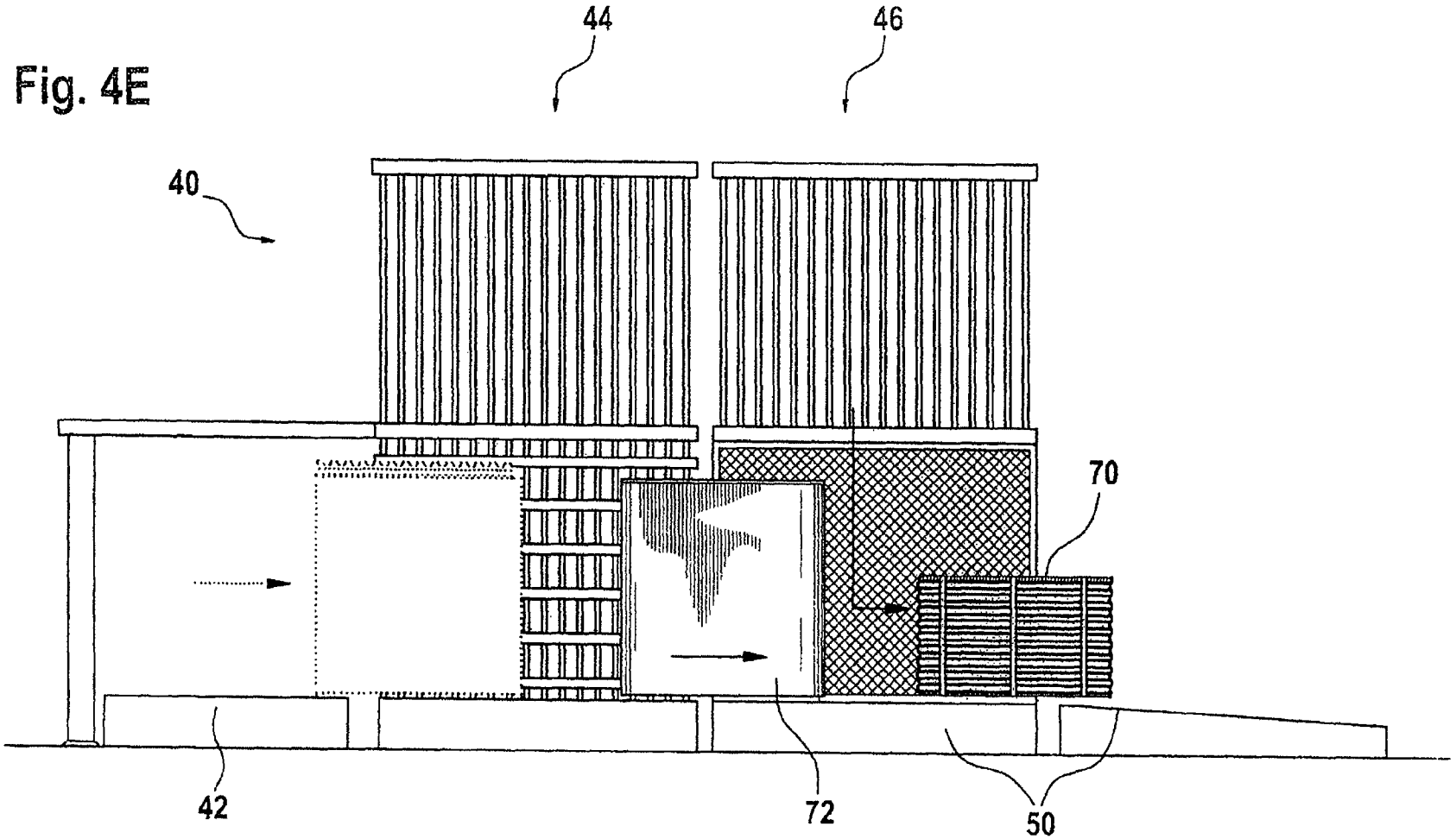

In FIG. 4D, the sliver package 70 now rests in the upper portion of the compression area 44, and the empty can 72 rests in the lower portion of the compression area 44. The sliver package 70 in a preferred embodiment is then conveyed by pushing it using a piston 48 or another suitable method to the elevator section 46 and, as can be seen in FIG. 4E, lowered to ground level to a conveyor 50 to allow the package 70 to be delivered to a collection point. Likewise, the empty can 72 may be delivered to an empty can collection point for reuse in another iteration of the method of the present invention.

Referring now to FIG. 5, there is shown an exemplary embodiment of the method described above in the form of a flow chart illustrating steps in the sliver package-forming process. At step 100, a bottom cap of an oblong profile is placed into a can having a lengthwise dimension and a widthwise dimension, with the lengthwise dimension being substantially longer than the widthwise dimension. In other words, the can is oblong as well. At step 102, the sliver is drawn from a draw frame in the direction of the sliver can. At step 104, the sliver is laid in a pattern having a substantially uniform uncompressed density into the can on top of the bottom cap.

At step 106, a top cap is placed upon the laid sliver pile. As has been noted above, the top and bottom caps are formed of a material of sufficient rigidity, in combination with strapping to be noted below, to prevent decompression of the sliver package. Such materials may include corrugated cardboard, fiberboard, plastic, or any other suitable material. The caps themselves may be provided with recesses for locating the straps.

At step 108, the can is delivered to a compression baler. The sliver pile is then pressed upward, driving it out of the can, at step 110. Pressure continues to be applied from the bottom; at step 112, counter-pressure is applied to the top of the pile, and the pile is thus compressed via the application of at least 3200 psi thereto. At step 114, the compressed sliver and caps are strapped to form a substantially rigid and independently stable package, and the straps retain the package at a desired compressed density selected to enable handling of the package without damage to the sliver. At step 116, the sliver package is delivered to a collection point and may be bagged or covered for transport.

The present invention combines a sliver deposition apparatus that forms a free-standing, i.e. canless sliver pile with an apparatus similar to that described in connection with FIGS. 4A-4E for forming a sliver package as shown in FIGS. 1 and 1A. However, because the sliver pile that is packaged starts out as free-standing, the provision of and disposition of cans in the process described above in connection with FIGS. 4A-4E, is completely eliminated, thus significantly simplifying the process, as will become apparent from the following description.

Figure 6A:
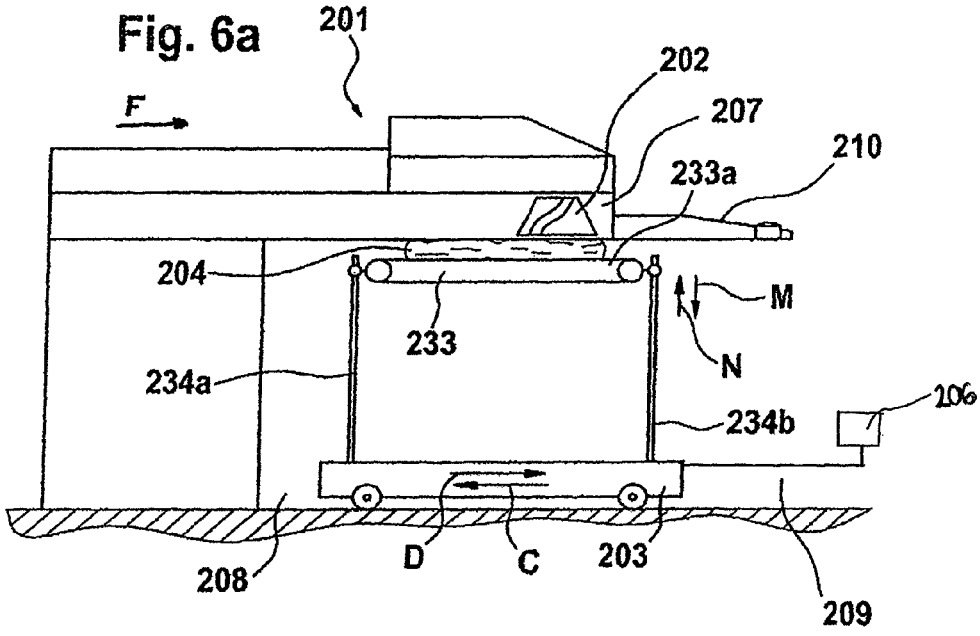
FIG. 6*a* is a diagrammatic side view of an embodiment having, for can-free sliver deposition and as a conveying-away device, a conveyor belt that can be raised and lowered, during the depositing procedure.
Figure 6B:
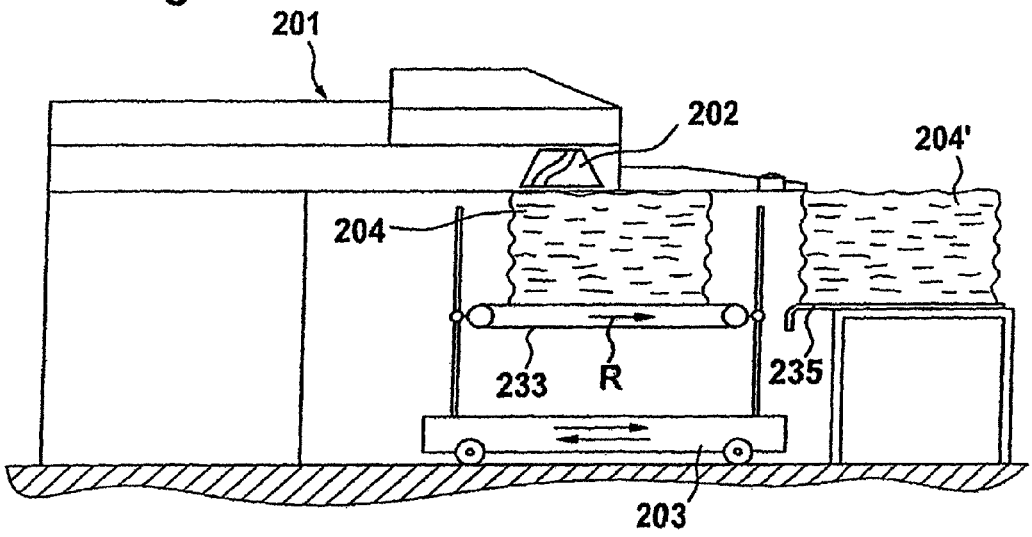
FIG. 6*b* is a diagrammatic side view of the embodiment of FIG. 6*a* during the conveying-away procedure.

Referring now to FIGS. 6*a* and 6*b*, sliver is delivered by a high-performance draw frame 201 (autoleveller draw frame), for example the HSR 1000 (trade mark) high-performance draw frame made by Trützchler GmbH & Co. KG of Monchengladbach, Germany. The fiber slivers, coming from cans (not shown) enter a drawing mechanism, and are drawn out therein. After exit from the drawing mechanism, the fiber slivers are combined to form a fiber sliver which passes through a revolving plate 202 and is then deposited in a can-free manner as a sliver pile 204 in a ring arrangement on a base provided on a carriage 203 which moves back and forth in the direction of arrows C and D. The carriage 203 is driven by a controllable drive motor (not shown) which is connected to an electronic control and regulation device, for example a machine control unit 206. Reference numeral 210 denotes a cover plate for the sliver-depositing device (coiler), which cover plate is connected to the supporting plate 207. Reference letter F denotes the work direction (flow of fiber material) in the draw frame, the fiber sliver 204 being deposited by the revolving plate 202 in a substantially perpendicular direction. Reference numeral 208 denotes the depositing area and reference numeral 209 denotes the area to the outside of the depositing are 208.

FIG. 6*a* shows one end position and FIG. 6*b* shows the other end position of the carriage 203, which moves back and forth horizontally beneath the revolving plate 202 in directions C, D during deposition of the fiber sliver 204. On the upper surface of the carriage 203 there is arranged a holding apparatus 234*a*, 234*b*, for example posts, on which a conveyor belt 233 is so mounted that its height can be adjusted in the direction of arrows M, N. The sliver pile 204 is deposited on the upper portion 233*a* of the conveyor belt 233, optionally on a plate (not shown in the drawing) arranged on the upper portion 233*a*. During sliver deposition, the carriage moves back and forth in the direction of arrows C, D. The sliver pile 204 is likewise moved back and forth beneath the revolving plate 2 in the direction of arrows C. D. After it has reached the end position shown in FIG. 6*a*, the carriage 203 moves in the direction of arrow D, during which the carriage 203 is accelerated, driven at constant velocity and then braked. After the carriage 203 has reached the end position shown in FIG. 6*b*, the carriage 203 moves back in the direction of arrow C, during which the carriage 203 is accelerated, driven at constant velocity and then braked. Switching-over between the back and forth movements is accomplished by means of a control device in conjunction with the drive motor, neither of which is shown in the drawings.

Each time an end position is reached, the conveyor belt 233 is adjusted downwards in direction M by about one fiber sliver thickness, for example 10 mm, by a drive motor (not shown). Referring to FIG. 6*b*, when fiber sliver deposition has been completed, the upper portion 233*a* of the belt is moved in direction R, for example by a controlled drive motor (not shown), so that the sliver pile 204[1] is slid onto a substantially level support plate 235 located alongside, for example a transportation tray. That edge of the support plate 235 which faces the carriage 203 may be, for example, beveled-off, rounded-off or the like. If, as described above, the sliver has been deposited onto a deposition plate (bottom cap 18) received on the conveyor belt 233, the plate together with the sliver pile may be slid onto an adjacent support, which may then if desired omit the plate 235. A top cap 16 may then be placed upon the top of the sliver pile 204[1] on the support plate 235 (and/or the deposition plate if present), and the sliver thereafter compressed and strapped, for example in the manner described with reference to FIGS. 4A to 4B, including the support plate 235 or the deposition plate, if present (acting in each case as bottom cap 18) and the top cap.

The carriage 203 is driven by a variable-speed electric motor (not shown) in a jolt-free or substantially jolt-free manner, that is smoothly. The velocity between acceleration and braking is constant. It is thus ensured that the sliver pile 204 remains stable both during back and forth movement within the depositing area 208 according to FIGS. 6*a* and 6*b*, and during a movement out from the depositing area 208. The movements are so controlled that a production rate which is as high as possible is achieved, without the sliver pile slipping or tipping over.

Figure 7:
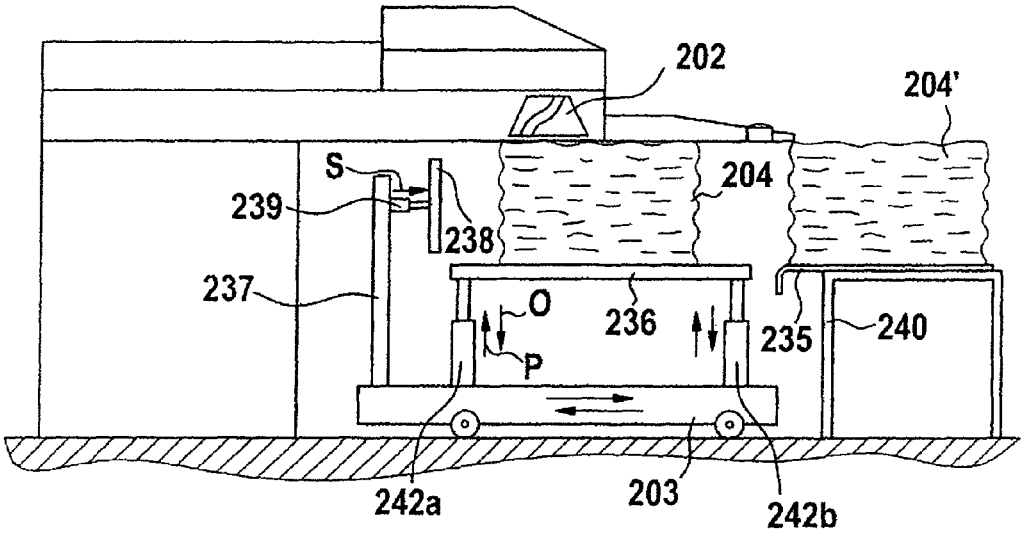
FIG. 7 is a diagrammatic side view of an embodiment having a push device for changing of the sliver pile in a can-free deposition arrangement.

FIG. 7 illustrates another exemplary embodiment involving can-free deposition wherein there is arranged on the carriage 203 a lifting platform 236, for example a plate, which can be mounted on holding elements in a manner known per se (see for example German patent document DE 445 07 849 A1), and adjusted in the direction of arrows O, P. A supporting element, for example a post 237, is provided on the carriage 203. A pushing device 238 is mounted on post 237 by a suitable controlled drive element 239, for example a pneumatic cylinder, spindle drive or the like. Each time an end position is reached, the platform 236 is adjusted downwards in direction O by about one fiber sliver thickness, for example, 10 mm. When deposition of the sliver pile 204 on the surface of the lifting platform 236 has been completed, the pushing device 238 is moved against the sliver pile 204 in the direction of arrow S so that the sliver pile 204 is pushed from the lifting platform 236 onto the support plat 235 as a result of direct contact pressure from the pushing device 238. The support plate 235 which rests on a stand 240 or the like, can be taken off the surface of the stand 240 together with the sliver pile 204. Optionally, instead of or in addition to support plate 235, there can be used during deposition a plate (bottom cap 18) that is received upon the platform 236 during deposition and which can be pushed, together with the sliver pile, onto the stand 240 or onto the support plate 235. A top cap 16 may be placed upon the sliver pile 204[1], and a compressing force may be applied to the sliver pile 204[1] between the top cap and the support plate 235 of the deposition plate (in each case acting as bottom cap 18), followed by strapping of the sliver pile 204[1] with the top cap 16 and the bottom cap 18, in the manner described above with reference to FIGS. 4A to 4E.

Figure 8:
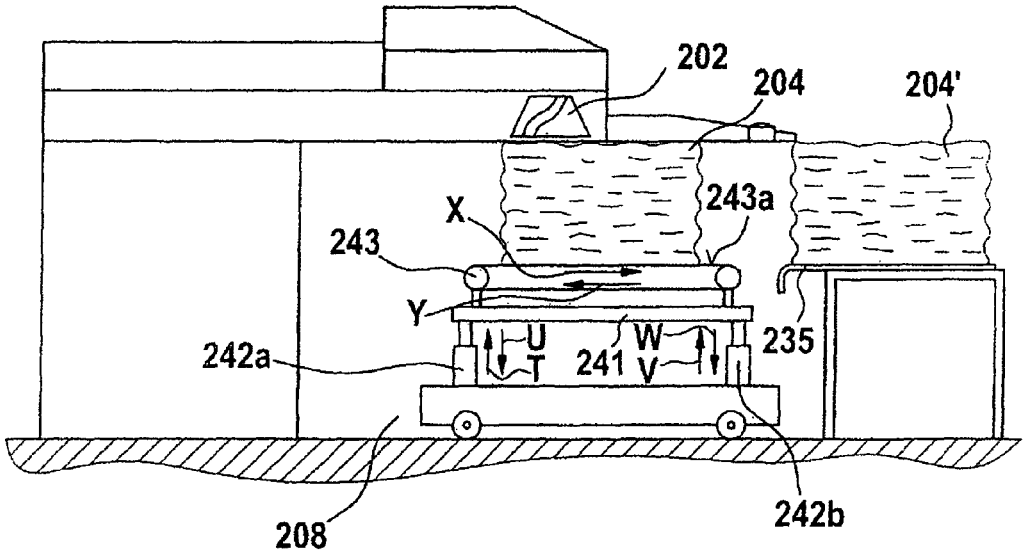
FIG. 8 is a diagrammatic side view of an embodiment having a lifting device and a relatively long conveyor belt which services, at the same time, for both movement back and forth during can-free deposition and for conveying-away.

FIG. 8 shows another exemplary embodiment wherein there is provided a lifting plate 241, which can be raised and lowered by lifting elements 242*a*, 242*b*, for example controlled pneumatic cylinders, in the direction of arrows T, U, and V, W. On the surface of the lifting plate 241 there is provided a conveyor belt 243, the belt portions of which can be moved in the direction of arrows X, Y by a drive motor and control means (not shown). During deposition, the upper portion 243*a* of the belt is moved back and forth in the direction of arrows X, Y beneath the revolving plate 202. After the fiber sliver has been deposited in the from of a sliver pile 204 on the upper portion 243*a* of the belt, the drive motor is so controlled by the control means that the upper portion 243*a* of the belt moves the sliver pile 204 out from the depositing area 208 beneath the revolving plate 202 and unloads it onto a support surface 235. Optionally, in analogous manner to that described with reference to FIGS. 6A, 6B and 7 above, the sliver may if desired be deposited onto a deposition plate (bottom cap 18) received on the belt 243, which can then be transferred with the sliver pile 204 to the adjacent support stand 240 (optionally provided with support surface 235). The unloaded sliver pile 204[1] can the be compressed, with the assistance of a top cap 18, and strapped as described with reference to preceding FIGS. 4A-4E.

FIGS. 6A, 6B, 7 and 8 show embodiments in which the sliver is deposited on a surface without the use of a can, that is, the surface upon which the sliver is deposited substantially unenclosed, in contrast to arrangements in which the sliver is deposited upon a bottom cap that is located in a sliver can. An advantage of such can-free depositing methods is that, while in the draw frame, a pressure can already be exerted on the silver pile 204, which is thereby pre-compressed. The use of cans thus can be dispensed with completely.

Figure 9:
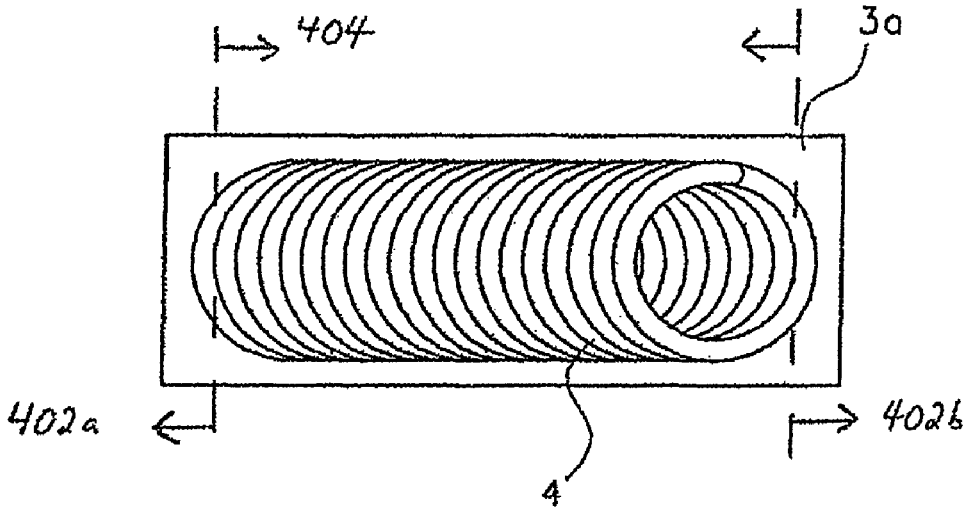
FIG. 9 is a top view of a sliver bundle deposited freely on the top of a carriage.
Figure 10:
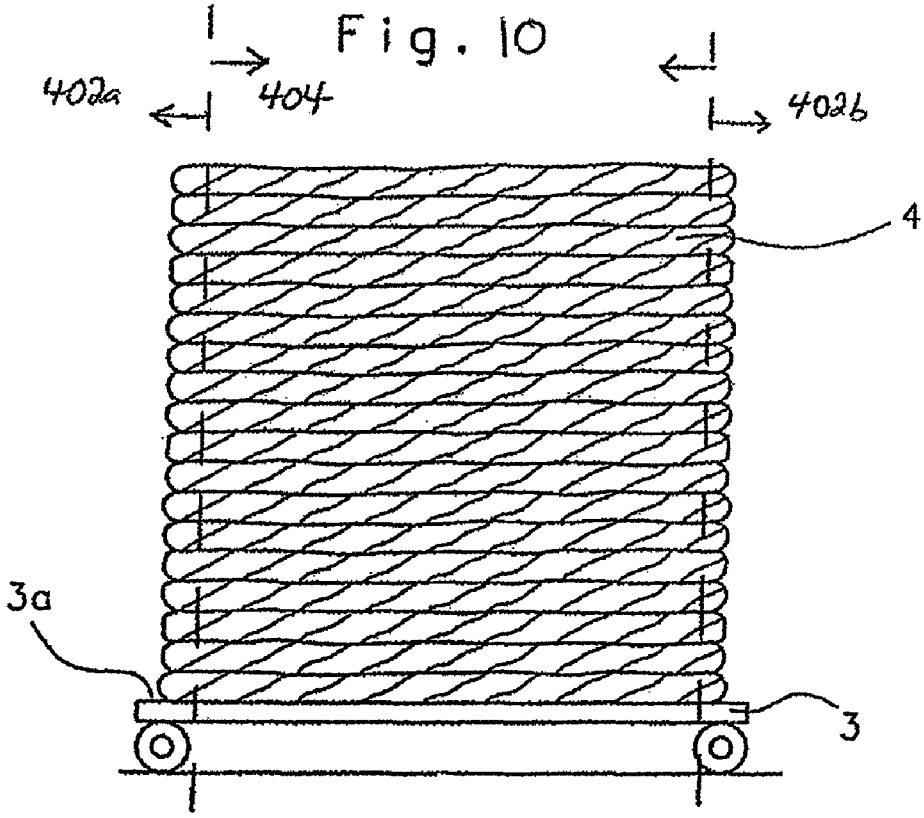
FIG. 10 is a side elevation view of the sliver bundle of FIG. 9.

The rate of the back and forth movement of the carriage 203 can also be controlled to increase the stability of the sliver bundle 204. Referring to FIGS. 9 and 10, as the carriage 203 reaches the reversal point at either end of the back and forth movement, the control unit 206 decelerates the carriage 203 as the carriage 203 approaches a seam area 402*a* or 402*b* of the sliver bundle 204 and accelerates the carriage 203 as the carriage leaves the seam area 402*a* or 402*b*. In between the seam areas 402*a* and 402*b* on either side of the sliver bundle 204, the control unit 206 controls the carriage 203 to have a constant speed. The seam area 402*a* or 402*b* is the location on either end of the sliver bundle 204 where the sliver rings deposited on the carriage 203 do not completely overlap (see FIGS. 9 and 10). The seam area 402*a* or 402*b* occurs shortly before the reversal point of the movement of the carriage 203 at either end of the sliver bundle 204. In contrast, in the non-seam area 404, during either the forward or backward movement of the carriage 203, the back edge of each sliver ring is deposited on top of the front edge of a previously deposited sliver ring.

To account for less sliver being deposited in the seam area 402*a* or 402*b*, the control unit 206 decelerates the carriage 203 so that more sliver may be deposited in the seam area 402*a* or 402*b* and accelerates the carriage 203 to a constant speed in the non-seam area 404. The deceleration of the carriage 203 increases the amount of sliver deposited in the seam area 402*a* or 402*b* since the revolving plate 202 discharges the sliver at a constant rate independent of the movement of the carriage 203. When the carriage 203 decelerates, more sliver may be deposited at that location to account for the non-overlapping rings of sliver near the reversal points. The non-uniform speed of the carriage 203 permits a substantially uniform amount of sliver to be deposited at both the seam area 402*a* or 402*b* and the non-seam area 404 of the sliver bundle 204 for each layer of sliver deposited in the back and forth movement of the carriage 203. The non-uniform speed of the carriage 203 also provides substantially uniform density of the sliver at all locations within the sliver bundle 204. This uniform density of sliver permits the sliver bundle 204 to be formed stably on the carriage 203 and allows the sliver bundle 204 to be accelerated back and forth while minimizing the possibility that the canless, laterally unsupported, sliver bundle 204 will become unstable and topple over.

In view of the aforesaid written description of the present invention, it will be readily understood by those persons skilled in the art that the present invention is susceptible of broad utility and application. Many embodiments and adaptations of the present invention other than herein described, as well as many variations, modifications, and equivalent arrangements, will be apparent from or reasonable suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise exclude any such other embodiments, adaptations, variations, modifications and equivalent arrangements, the present invention being limited only by the claims appended hereto and the equivalents thereof.

What is claimed is:

1. A can-free system for handling fiber sliver, comprising:

a sliver delivery device to form and deposit fiber sliver in a laterally unenclosed free-standing fiber sliver pile, wherein the sliver delivery device comprises a rotary revolving plate;

a moveable sliver receiving device located beneath the rotary revolving plate, the sliver receiving device comprising a horizontal surface and a laterally unenclosed space above the horizontal surface, wherein the rotary revolving plate deposits the fiber sliver in rings on the horizontal surface to form the laterally unenclosed free-standing sliver pile;

a control unit operably coupled to the sliver receiving device, said control unit being adapted to move the sliver receiving device back and forth in the horizontal direction at a non-uniform speed, wherein the non-uniform speed is constant in a non-seam area of the laterally unenclosed free-standing fiber sliver pile and the constant speed decelerates in a seam area of the laterally unenclosed free-standing fiber sliver pile;

a mechanical device cooperating with the sliver receiving device to push the laterally unenclosed free-standing fiber sliver pile off the horizontal surface; and a packaging apparatus comprising a device to compress the collected free-standing fiber sliver pile and a device to apply one or more straps to the compressed free-standing fiber sliver pile.

2. The can-free system according to claim 1, wherein the horizontal surface receives and collects the fiber sliver delivered by the delivery device in the form of a free-standing sliver pile.

3. The can-free system according to claim 2, further comprising a bottom cap on which the sliver pile is placed, a top cap for placement on top of the sliver pile, and a compression mechanism to compress the sliver pile between the top cap and the bottom cap.

4. A can-free system according to claim 3, wherein the horizontal surface serves both as a receiving surface and the bottom cap.

5. The can-free system according to claim 3, wherein the horizontal surface comprises a first planar surface that first receives the fiber sliver, and further including a mechanism to transfer the free-standing sliver pile from the first planar surface onto the bottom cap.

6. The can-free system according to claim 1, wherein the receiving device has a fixed horizontal position.

7. The can-free system according to claim 1, wherein the receiving device is arranged to be raised and lowered vertically.

8. The can-free system according to claim 1, wherein the receiving device comprises an upper surface of a conveyor belt.

9. The can-free system according to claim 1, wherein the receiving device comprises part of a transportation device to move the deposited free-standing sliver pile.

10. The can-free system according to claim 9, wherein the transportation device comprises a carriage.

11. The can-free system according to claim 9, wherein the receiving device comprises a part of a conveyor belt arranged on the transportation device.

12. The can-free system according to claim 1, wherein the mechanical device comprises one of a pushing device or a sliding device.

13. The can-free system according to claim 1, wherein the receiving device comprises a lifting and lowering device.

14. The can-free system according to claim 13, wherein the lifting and lowering device comprises at least one of a hydraulic cylinder, a pneumatic cylinder, a scissors framework, or spring elements.

15. The can-free system according to claim 1, wherein the receiving device comprises part of a lifting platform.

16. The can-free system according to claim 15, wherein the lifting platform is operative to enhance sliding of the collected fiber sliver.

17. The can-free system according to claim 1, further including a base member onto which the deposited fiber sliver is conveyed from a depositing area.

18. An apparatus for packaging a free-standing fiber sliver pile, comprising:

a sliver delivery device to form and deposit fiber sliver in a laterally unenclosed free-standing fiber sliver pile, wherein the sliver delivery device comprises a rotary revolving plate, the free-standing fiber sliver pile having a top surface and a bottom surface;

a depositing area comprising a moveable sliver receiving device located beneath the rotary revolving plate, the sliver receiving device comprising a horizontal surface with laterally unenclosed sides, wherein the rotary revolving plate deposits the sliver in rings on the horizontal surface;

a control unit operably coupled to the sliver receiving device, said control unit being adapted to move the sliver receiving device back and forth in the horizontal direction at a non-uniform speed, wherein the non-uniform speed is constant in a non-seam area of the laterally unenclosed free-standing fiber sliver pile and the constant speed decelerates in a seam area of the laterally unenclosed free-standing fiber sliver pile;

a mechanical device cooperating with the sliver receiving device to push the laterally unenclosed free-standing fiber sliver pile off the horizontal surface;

a device to apply pressure to at least one of the top surface and the bottom surface of the free standing fiber sliver pile for compressing the free-standing sliver pile to a desired density; and a strapping device to apply one or more straps to the compressed free standing sliver pile to retain the compressed fiber sliver pile in a compressed condition as a sliver package.

19. The can-free system according to claim 18, wherein the fiber sliver comprises at least one of cotton, synthetic fiber or a synthetic fiber blend.

20. A method of packaging a laterally unenclosed free-standing fiber sliver pile, comprising:

forming a laterally unenclosed free-standing fiber sliver pile by depositing rings of fiber sliver on a sliver receiving device having a horizontal surface with a laterally unenclosed space above the horizontal surface using a rotary revolving plate;

moving the receiving device back and forth in a horizontal direction at a non-uniform speed, wherein the non-uniform speed is constant in a non-seam area of the laterally unenclosed free-standing fiber sliver pile and the constant speed decelerates in a seam area of the laterally unenclosed free-standing fiber sliver pile;

displacing the laterally unenclosed free-standing fiber sliver pile from the sliver receiving device to a packaging apparatus, wherein the displacing step includes displacing the laterally unenclosed free-standing fiber sliver pile off the horizontal surface by a mechanical device cooperating with the sliver receiving device;

locating a bottom cap on a bottom of the laterally unenclosed free-standing sliver pile at the packaging apparatus;

placing a top cap on the laterally unenclosed free-standing sliver pile at the packaging apparatus;

compressing the laterally unenclosed free-standing sliver pile between the top and bottom caps at the packaging apparatus; and applying straps to the compressed laterally unenclosed free-standing sliver pile at the packaging apparatus.

21. The method of claim 20, including receiving the laterally unenclosed free-standing sliver pile on a planar surface during the forming step, and wherein the locating step includes transferring the laterally unenclosed free-standing sliver pile from the planar surface onto the bottom cap.

22. The method of claim 20, wherein the forming step includes depositing sliver directly onto the bottom cap.

23. The method of claim 20, wherein the forming step includes depositing sliver on a receiving device and lowering the receiving device during the depositing step.

24. The method of claim 20, wherein the forming step includes delivering sliver through the rotary revolving plate during the back and forth movement of the receiving device to form rings on the receiving device.

* * * * *